US007236076B2

(12) United States Patent
Lee

(10) Patent No.: US 7,236,076 B2
(45) Date of Patent: Jun. 26, 2007

(54) ELECTRIC COMPONENT HAVING A VARIABLE AIR GAP EFFECT

(75) Inventor: Mu-Tu Lee, Taipei County (TW)

(73) Assignee: Jung Fong Electronics Co., Ltd., Taipei County (TW)

( * ) Notice: Subject to any disclaimer, the term of this patent is extended or adjusted under 35 U.S.C. 154(b) by 0 days.

(21) Appl. No.: 11/274,285

(22) Filed: Nov. 16, 2005

(65) Prior Publication Data

US 2006/0103496 A1 May 18, 2006

(30) Foreign Application Priority Data

Nov. 16, 2004 (TW) ..... 93218279 U
Nov. 16, 2004 (TW) ..... 93218280 U

(51) Int. Cl.
*H01F 17/06* (2006.01)

(52) U.S. Cl. ..... 336/178; 336/234

(58) Field of Classification Search ..... 336/65, 336/83, 178, 212, 233–234
See application file for complete search history.

(56) References Cited

U.S. PATENT DOCUMENTS 1,353,711 A * 9/1920 Bergman ..... 323/331
1,582,524 A * 4/1926 Latour ..... 336/79
7,009,482 B2 * 3/2006 Kiko et al. ..... 336/84 C
2004/0178877 A1 9/2004 Lin
2005/0258927 A1 * 11/2005 Lu ..... 336/234

FOREIGN PATENT DOCUMENTS

TW 545686 8/2003

* cited by examiner

*Primary Examiner*—Tuyen T. Nguyen
(74) *Attorney, Agent, or Firm*—Birch, Stewart, Kolasch & Birch, LLP

(57) ABSTRACT

An electric component having a variable air gap effect comprises two cores having a magnetic field air gap disposed at the connecting position of the two cores, and a coil wound around the cores and disposed at the installing position of the magnetic field air gap, and at least one core includes at least one magnetism generating end disposed at the magnetic field air gap and a magnetic flux section coupled to the magnetism generating end, and the cores also includes at least one air gap opening, such that the air gap opening changes the path and direction of the magnetic lines and provides a variable air gap according to the magnetic field air gap, so as to improve the electric functions of the electric component.

18 Claims, 7 Drawing Sheets

ELECTRIC COMPONENT HAVING A VARIABLE AIR GAP EFFECT

FIELD OF THE INVENTION

The present invention relates to an electric component having a variable air gap effect, and more particularly to an electric component comprises a multiple of air gaps to produce variable air gaps to achieve better electric functions.

BACKGROUND OF THE INVENTION

In the air gap design of an electric component, the air gap provides a magneto-impedance effect to the electric component for preventing a magnetic saturation phenomenon. At present, the air gap used for the electric components usually comes with a single size. If the air gap of an electric component is too small, then a larger current will pass through the electric component at a low-voltage output condition, and the saturation will occur to produce a significant temperature rise. If the air gap is too large, the electric component will lack of sufficiency for preventing harmonic distortions when the electric component is at a light-load output condition. Therefore, a single size of the air gap cannot satisfy the harmonic wave standard of an electric component under the light-load or full-load condition.

R.O.C. Pat. Publication No. 545686 and U.S. Pat. Publication No. 2004-0178877A1 disclosed the multiple air gap technologies.

In R.O.C. Pat. Publication No. 545686, an electric component forms an air gap with different thicknesses by a paper plate disposed between two cores, so that the curved surface of the air gap is substantially in a stairway-like surface, a slanting surface, or a continuous wavy surface to provide a variable air gap effect as shown in FIG. 1. U.S. Pat. Publication 2004-0178877A1 used a plurality of silicon steel plates having a magnetic flux of different lengths and widths form the cores, such that the air gap with different distances between the two cores will be formed to achieve the variable air gap effect. In the meantime, the effects of reducing the number of coils or stacks of silicon steel plates under the same power condition can be achieved to lower the manufacturing cost and reduce the overall volume of the electric component.

However, the aforementioned two patented technologies cannot achieve the accurate control effect primarily because the curved surface or different distances of the air gap cannot be used to calculate the actual light-load or full-load power accurately, and the manufacture of the electric component involves different specifications due to the factors of human assembling or the errors of manufacturing tools. If there is a new specification, the existing specification for the electric components cannot be used anymore, and it is necessary to perform experiments repeatedly to find an appropriate air gap, and the process is very laborious.

SUMMARY OF THE INVENTION

The primary objective of the present invention is to overcome the shortcomings of the prior art and avoid the existing deficiencies by providing an electric component capable of classifying and recording different air gap combinations and the values of variable air gaps. The electric component comprises two cores having a magnetic field air gap disposed at the connecting position between the two cores, and a coil wound around the cores and disposed at the installing position of said magnetic field air gap, and winding the exterior of the cores with coils at the position of the magnetic field air gap. At least one core includes at least one magnetism generating end disposed at the magnetic field air gap and a magnetic flux section coupled to the magnetism generating end. The core also includes at least one air gap opening disposed on the core for changing the path and direction of the magnetic lines and providing a variable air gap to cope with the magnetic field air gap, so as to improve the electric functions of the electric components. The manufacturer only needs to record the variation of each air gap magnitude to comply with the manufacturing specification of the electric component.

DETAILED DESCRIPTION OF THE PREFERRED EMBODIMENTS

The technical contents of the present invention will now be described in more detail hereinafter with reference to the accompanying drawings that show various embodiments of the invention.

Figure 2:
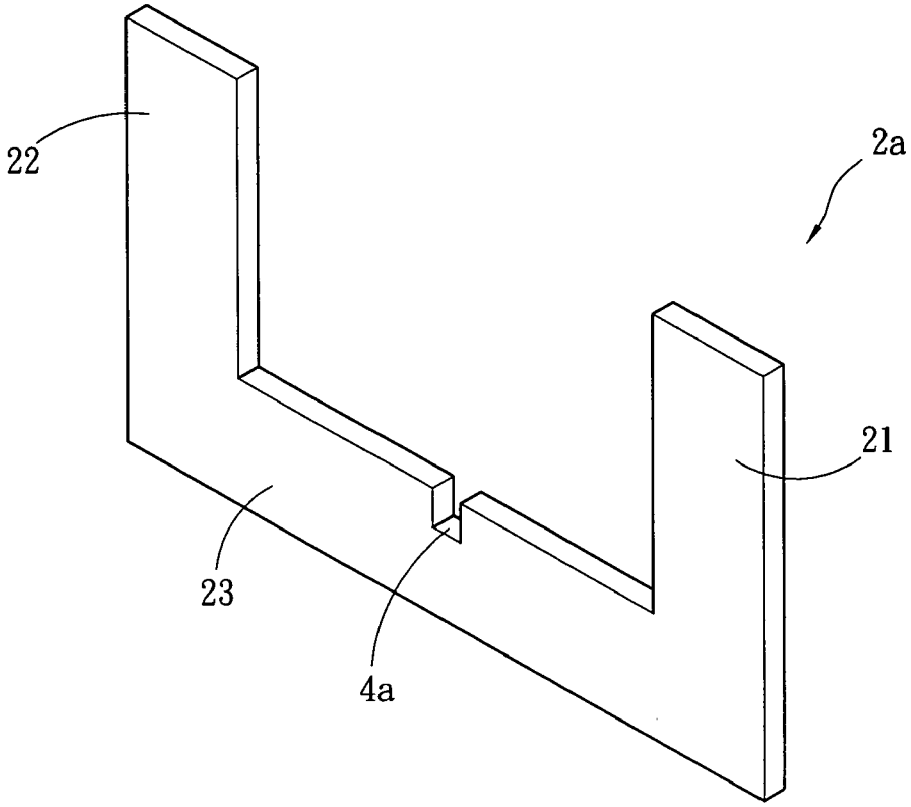
FIG. 2 is a schematic view of a silicon steel plate of the invention.
Figure 3:
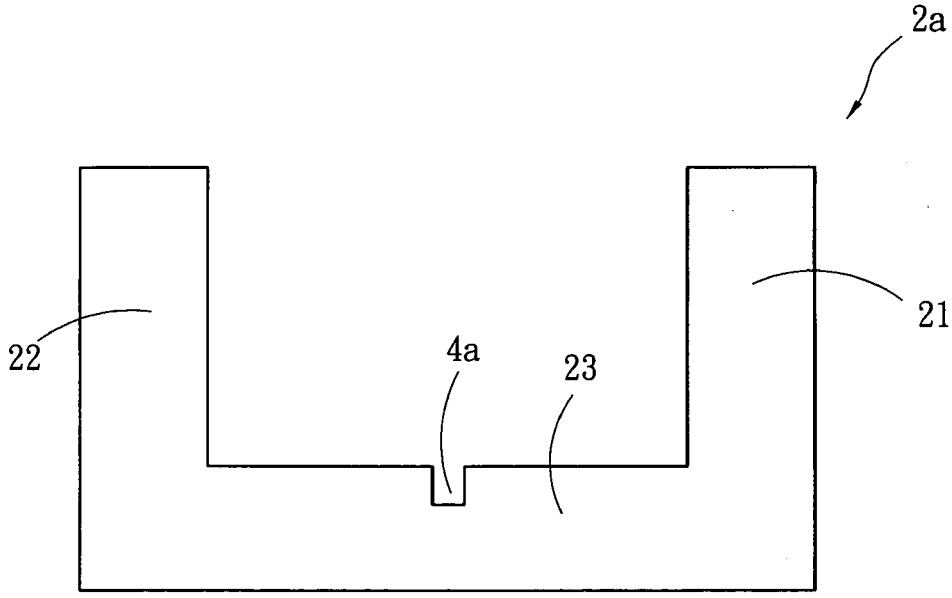
FIG. 3 is a schematic planar view of FIG. 2.
Figure 4:
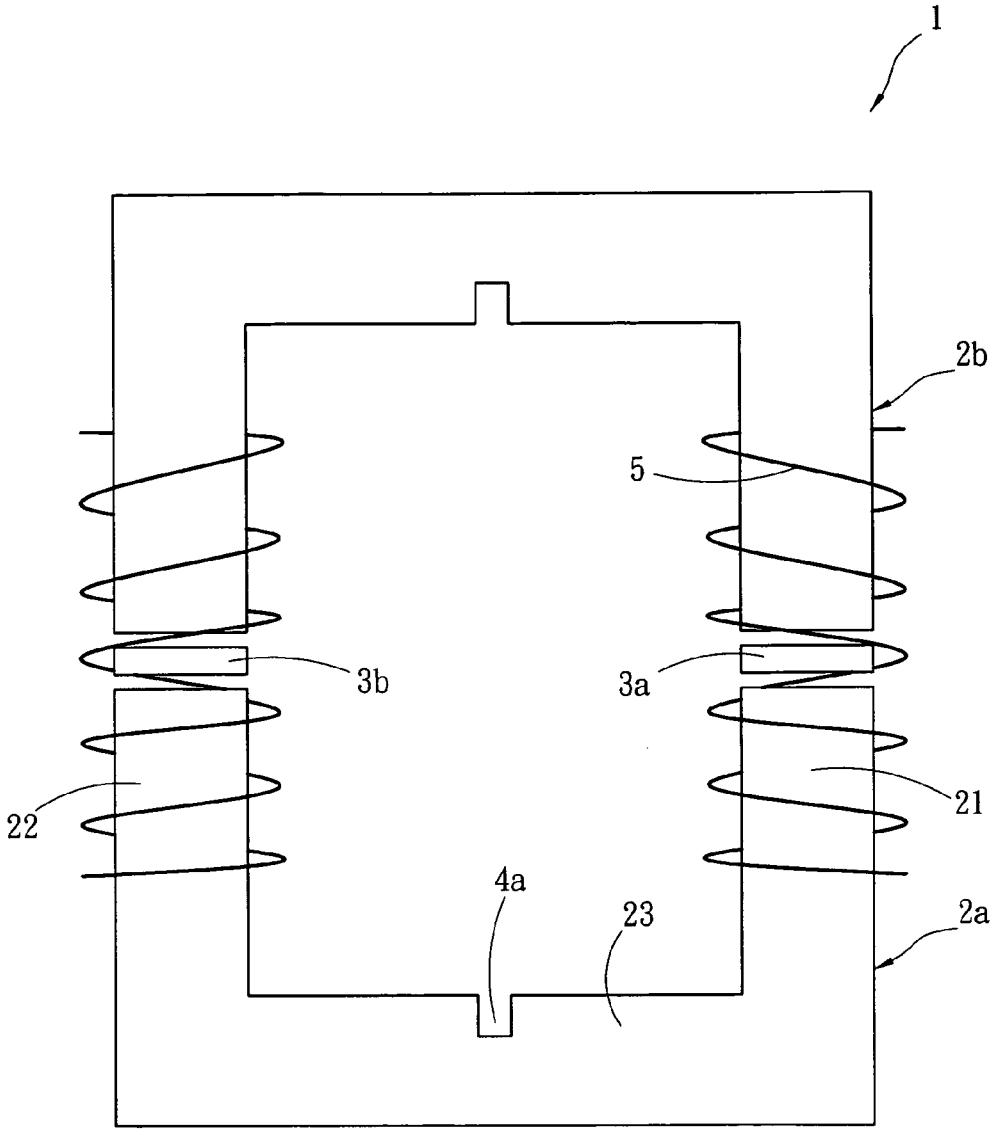
FIG. 4 is a schematic view of an UU-type electric component of the invention.
Figure 5:
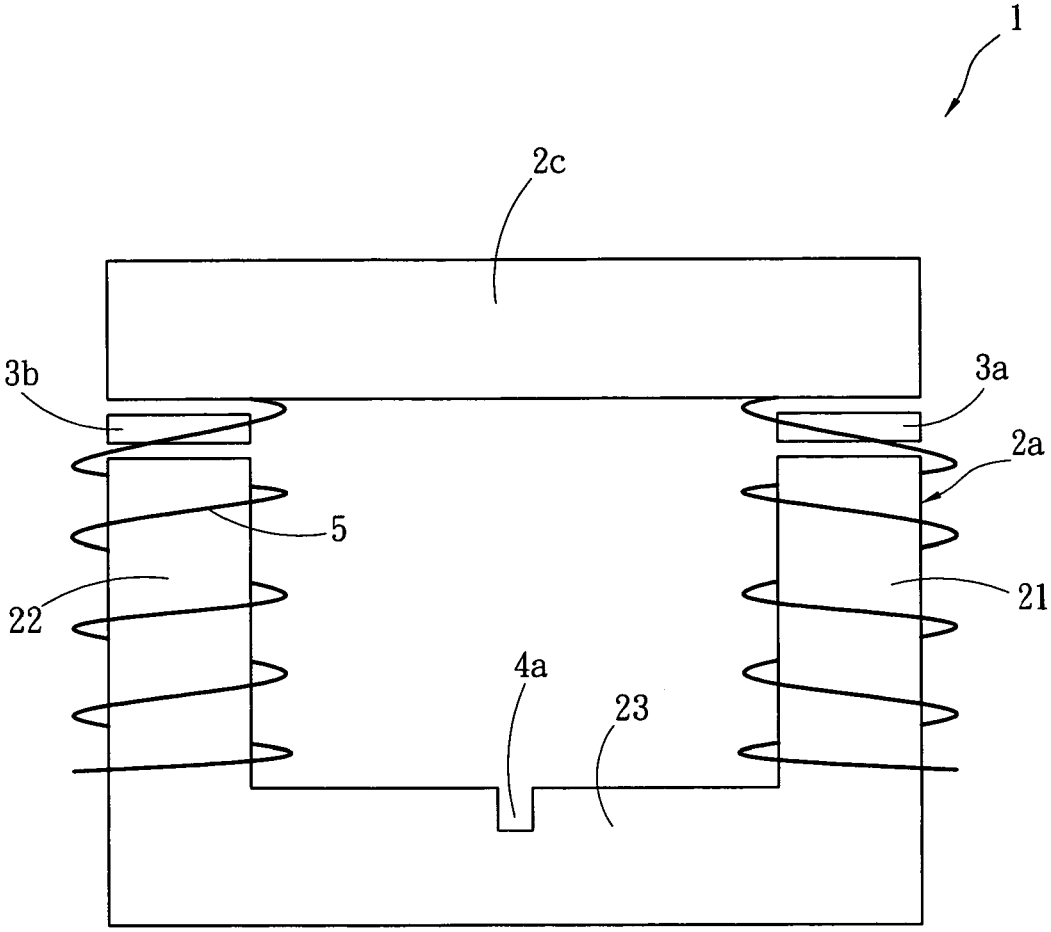
FIG. 5 is a schematic view of an UI-type electric component of the invention.
Figure 6:
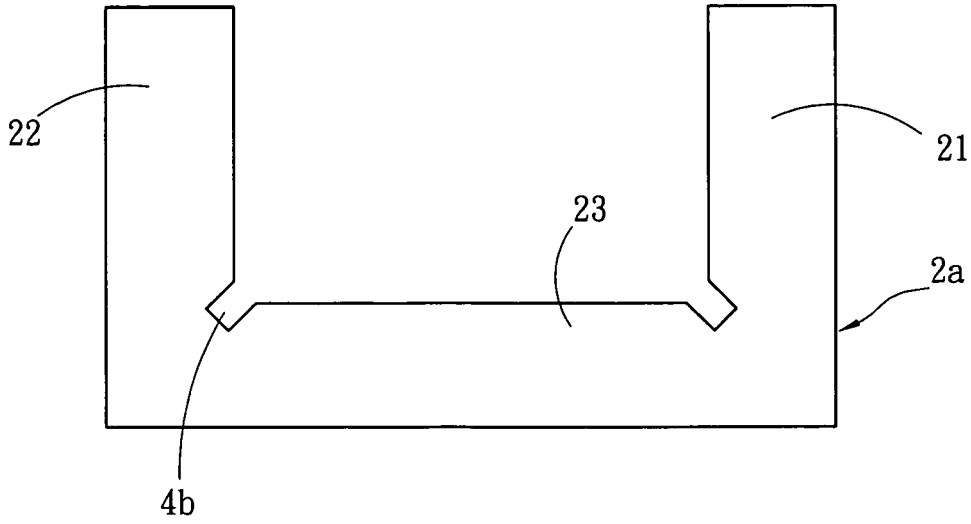
FIGS. 6 and 7 are schematic views of another application of the invention.
Figure 7:
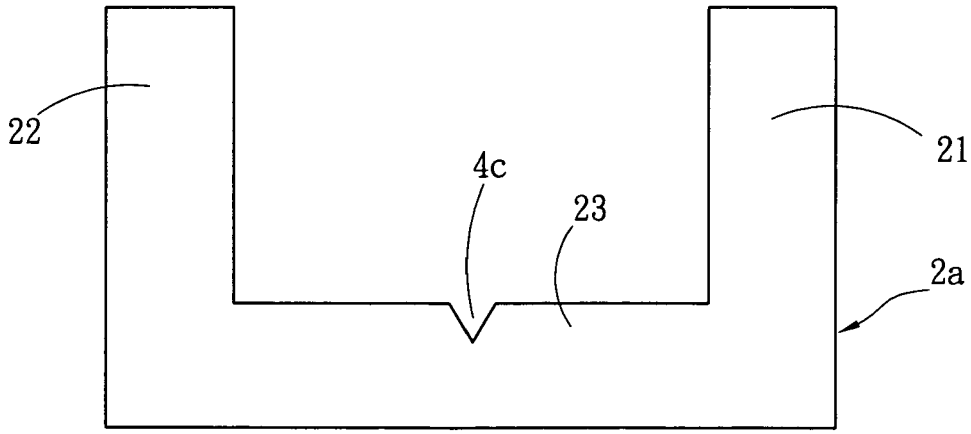
Figure 8:
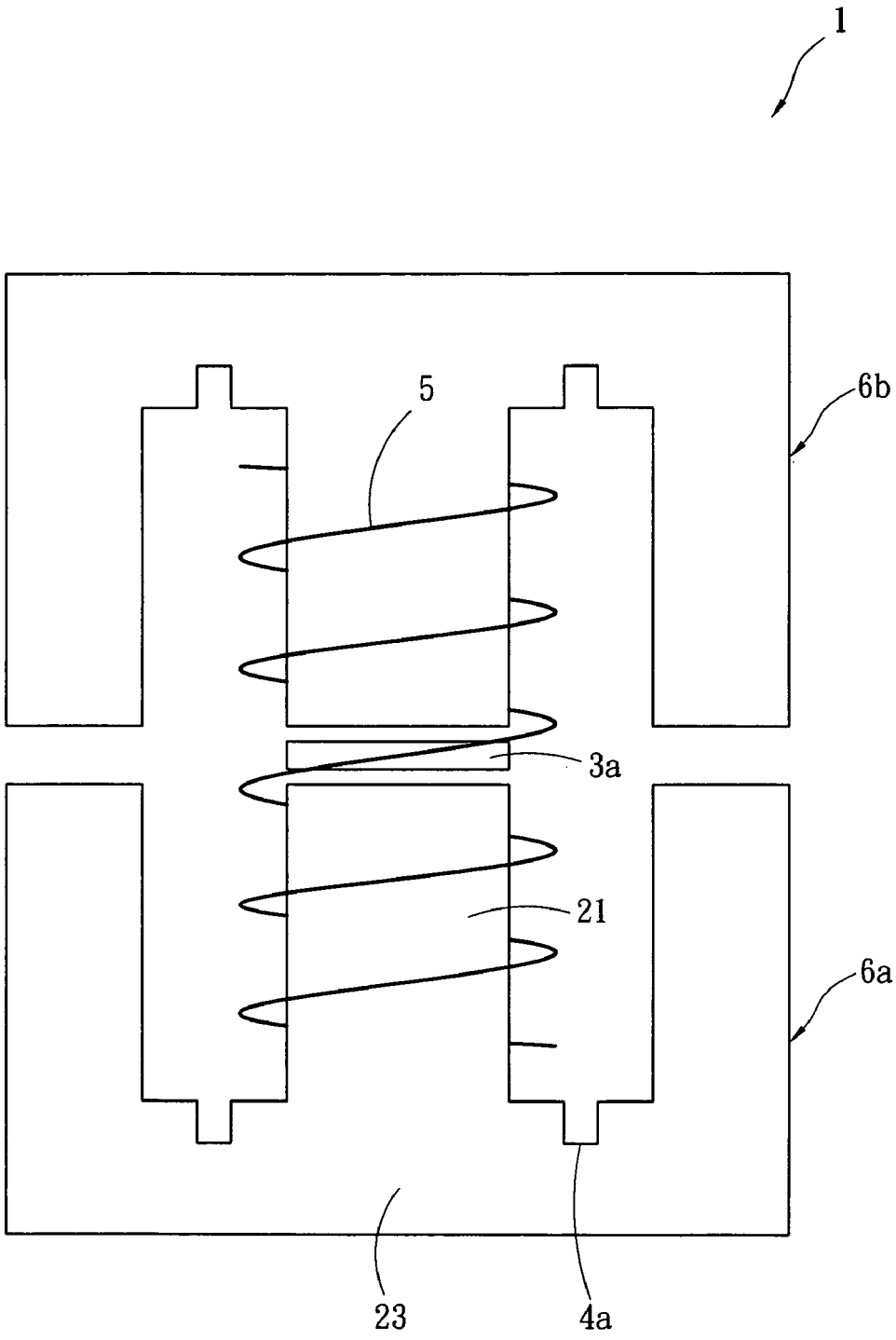
FIG. 8 is a schematic view of an EE-type electric component of the invention.
Figure 9:
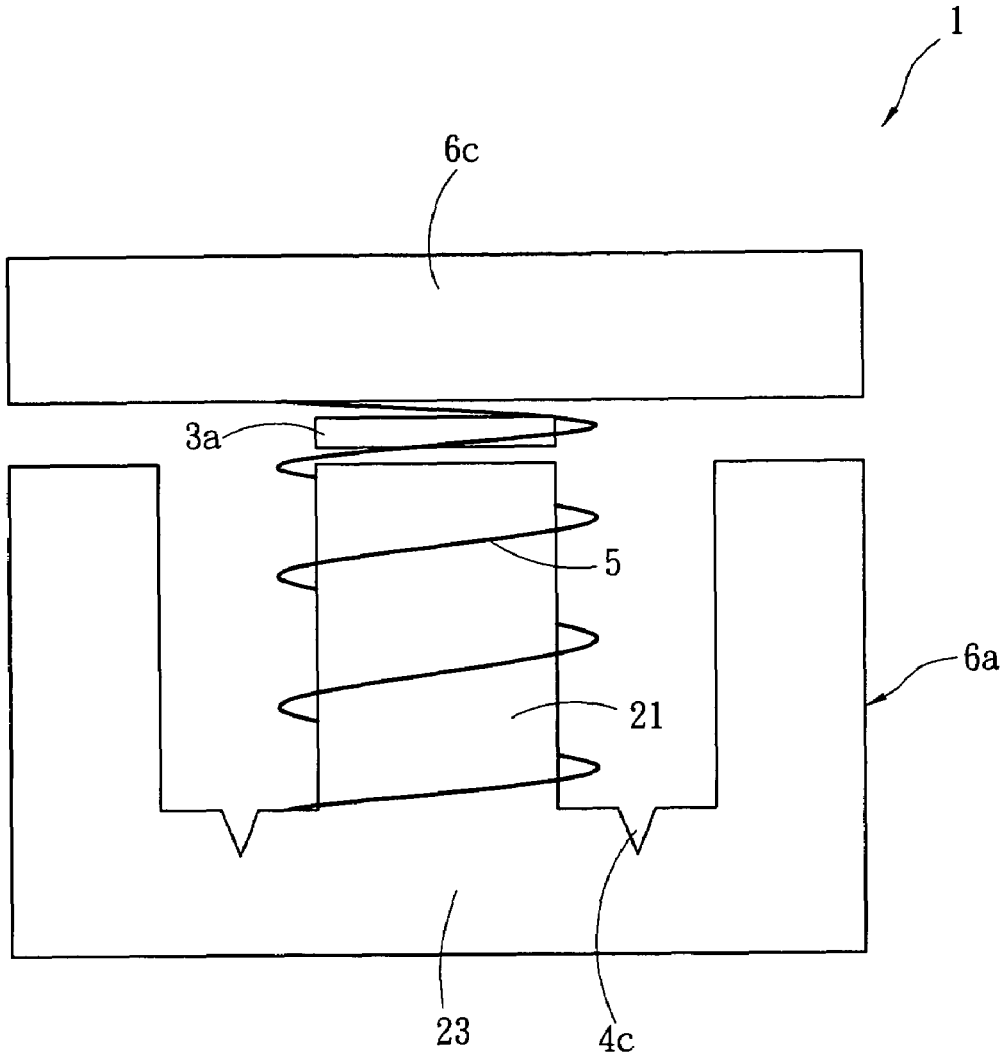
FIG. 9 is a schematic view of an EI-type electric component of the invention.

Referring to FIGS. 2, 3 and 4, an electric component 1 having a variable air gap effect comprises two cores 2*a*, 2*b* disposed at a magnetic field air gap 3*a*, 3*b* and wound around the core 2*a*, 2*b*, and a coil 5 disposed at the magnetic field air gap 3*a*, 3*b*, wherein at least one core 2*a* includes two magnetism generating ends 21, 22 disposed at the magnetic field air gap 3*a*, 3*b* and a magnetic flux section 23 coupled to the two magnetism generating ends 21, 22. The electric component 1 could be comprised of an UU-type core 2*a*, 2*b* as shown in FIG. 4 (the U-type cores 2*a*, 2*b* are disposed on both sides of the two magnetism generating ends 21, 22). The electric component 1 also could be comprised of an UI-type core 2*a*, 2*c* as shown in FIG. 5, or an EE-type core 6*a*, 6*b* as shown in FIG. 8 (the two magnetism generating ends 21 of the EE-type cores 6*a*, 6*b* are disposed at the central position), or an EI-type cores 6*a*, 6*c* as shown in FIG. 9. The cores 2*a*, 2*b*, 2*c* here refer to the cores made by stacking a plurality of silicon steel plates. The main characteristics of the design of the present invention reside on that the cores 2*a*, 2*b* have at least one air gap opening 4*a*, and the position of the air gap opening 4*a* is designed at the position of the magnetic flux section 23 as shown in FIG. 3 or 8, or the air gap opening 4*b* is designed at the connecting corner of the two magnetism generating ends 21, 22 and the magnetic flux section 23 as shown in FIG. 6. The air gap opening 4*a*, 4*b* also can be designed at the two magnetism generating ends 21, 22. The air gap opening 4*a*, 4*b* could be in the shape of a square as shown in FIGS. 7 and 9, and the air gap opening 4*c* also could be in a triangular shape or any other geometric shape.

Figure 1:
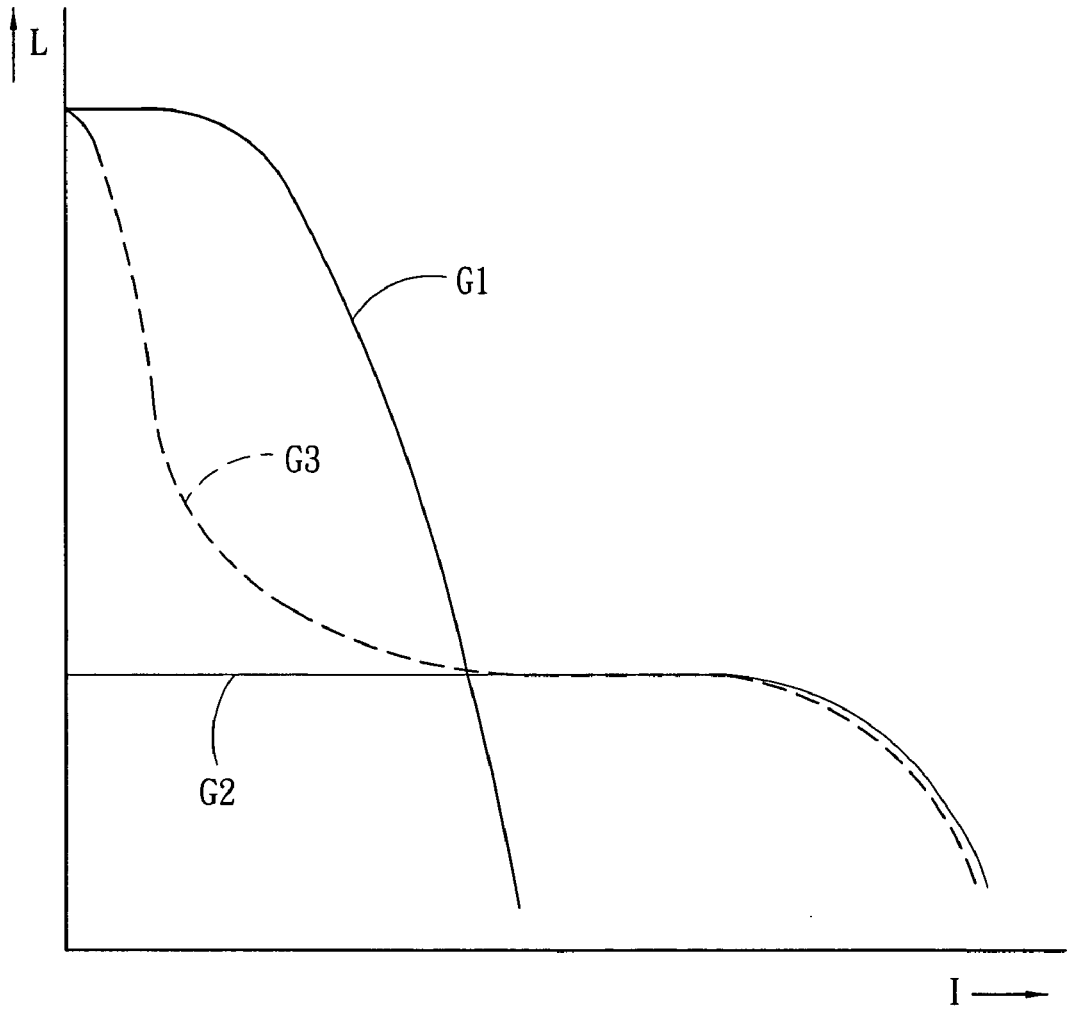
Fig. 1 PRIOR ART
FIG. 1 is a schematic view of the magnetic properties of a multiple air gap assembly of an electric component of the invention.

Referring to FIG. 1, the two magnetism generating ends 21, 22 of the core 2*a*, 2*b* have a magnetic field air gap 3*a*, 3*b*, and the magnetic field air gap 3*a*, 3*b* has a magneto-impedance. Assumed that the magneto-impedance is equal to a small gap curve G1 as shown in FIG. 1, the core 2*a*, 2*b* of the invention also has another air gap opening 4*a* and such air gap opening 4*a* also produces a magneto-impedance effect, and such magneto-impedance is assumed to be equal to the large air gap curve G2 as shown in FIG. 1. Therefore, the electric component 1 of the invention generates a variable air gap curve G3, so that the electric component 1 can meet the harmonic wave standard under the light-load condition. The electric component 1 has a larger inductance and will not be saturated easily under a low-voltage output condition, so as to lower the temperature rise and improve the power efficiency. In addition, the electric component 1 of this sort can reduce the number of windings of the coil 5 and the stacks of the silicon steel plates under the same output power condition, so as to achieve the effects of lowering the material cost and reducing the overall volume of the electric component 1.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electric component having a variable air gap effect, said electric component comprising two cores, having a magnetic field air gap disposed at the connecting position between said two cores, and a coil wound around said cores and disposed at the installing position of said magnetic field air gap, the electric component comprising:

at least one core having at least one magnetism generating end that forms said magnetic field air gap and a magnetic flux section coupled to said magnetism generating end, and said core comprises at least one air gap opening spaced from the magnetic field air gap and in contact with the magnetic flux section, such that said air gap opening changes the path of magnetic lines and provides a variable air gap effect according to said magnetic field air gap.

2. The electric component having a variable air gap effect of claim 1, wherein said air gap opening is disposed at said magnetism generating end.

3. The electric component having a variable air gap effect of claim 1, wherein said air gap opening is disposed at said magnetic flux section.

4. The electric component having a variable air gap effect of claim 1, wherein said air gap opening is disposed at a connecting corner of said magnetism generating end and said magnetic flux section.

5. The electric component having a variable air gap effect of claim 1, wherein said cores are UI-type.

6. The electric component having a variable air gap effect of claim 1, wherein said cores are UU-type.

7. The electric component having a variable air gap effect of claim 1, wherein said cores are EI-type.

8. The electric component having a variable air gap effect of claim 1, wherein said cores are EE-type.

9. The electric component having a variable air gap effect of claim 1, wherein the magnetism generating end and the magnetic flux section meet at a corner and wherein the air gap opening is disposed in the corner.

10. The electric component having a variable air gap effect of claim 9, wherein the air gap opening has a square shape.

11. The electric component having a variable air gap effect of claim 1, wherein the air gap opening has a square shape.

12. The electric component having a variable air gap effect of claim 1, wherein the air gap opening has a triangular shape.

13. The electric component having a variable air gap effect of claim 1, wherein the air gap opening is a recess formed in the magnetic flux section.

14. The electric component having a variable air gap effect of claim 13, wherein the air gap opening is at a mid-point of the magnetic flux section.

15. The electric component having a variable air gap effect of claim 1, wherein the air gap opening has a square shape.

16. The electric component having a variable air gap effect of claim 1, wherein at least one of the cores has an E-shape, the magnetic flux section having an at least two air gaps.

17. The electric component having a variable air gap effect of claim 1, wherein the magnetic flux section is entirely a linear section directly connected to the at least one magnetism generating end.

18. The electric component having a variable air gap effect of claim 17, wherein two magnetism generating ends are provides as the at least one magnetism generating end and wherein each end of the magnetic flux section has one of the magnetism generating ends connected to an end thereof at a right angle.

* * * * *